United States Patent [19]

Daw et al.

[11] Patent Number: 4,909,013

[45] Date of Patent: Mar. 20, 1990

[54] MODULAR WALL SYSTEM FOR CLEAN ROOM STRUCTURE

[75] Inventors: Terry L. Daw, Murray; William Lee, Salt Lake City, both of Utah

[73] Assignee: Daw, Inc., Salt Lake City, Utah

[21] Appl. No.: 201,074

[22] Filed: May 31, 1988

[51] Int. Cl.[4] ..... E04C 2/38; F24F 7/10

[52] U.S. Cl. ..... 52/762; 52/393; 52/394; 52/467; 52/471; 52/770; 52/781

[58] Field of Search ..... 52/588, 395, 396, 394, 52/393, 403, 471, 461, 462, 469, 465, 466, 470, 467, 584, 582, 762, 772, 770, 775, 781

[56] References Cited

U.S. PATENT DOCUMENTS

| | | | |
|---|---|---|---|
| 1,957,933 | 5/1934 | Brandl | 52/467 |
| 2,867,857 | 1/1959 | McCarthy . | |
| 2,907,287 | 10/1959 | Trostle | 52/467 |
| 3,232,395 | 2/1966 | La Barge | 52/395 |
| 3,327,443 | 6/1967 | Gay | 52/467 |
| 3,708,943 | 1/1973 | Thomas | 52/395 |
| 3,975,880 | 8/1976 | Fischer, Jr. . | |
| 4,075,811 | 2/1978 | Keith | 52/465 |
| 4,366,656 | 1/1983 | Simpson | 52/395 |
| 4,461,131 | 7/1984 | Pressell . | |
| 4,649,684 | 3/1987 | Petree et al. . | |
| 4,667,579 | 5/1987 | Daw . | |
| 4,671,038 | 6/1987 | Porter | 52/465 |

*Primary Examiner*—John E. Murtagh

*Attorney, Agent, or Firm*—Thorpe, North & Western

[57] ABSTRACT

A modular wall system adapted for use as part of a clean room structure, comprising a plurality of unibody panel sections, each panel section having a uniform width and including an exterior face, an interior face, and laterally opposing assembly flanges extending along the length of each edge of the panel section. Each assembly flange includes (i) a flange side wall extending inward from the interior face, (ii) an interlocking member adapted to be engaged with another interlocking member of a separate panel to secure the two flanges together, and (iii) a sealing member for sealing openings between coupled assembly flanges. A support channel configured in size and shape for snug fit around the coupled assembly flanges includes a channel cap and side channel walls which extend for equal lengths sufficient to abut against the interior faces of the coupled panel sections. These side walls operate as spacer members for aligning panel sections as the assembly flanges are secured within the support channel. Gripping members are coupled between the support channel and respective interlocking members of coupled assembly flanges for securing the above elements into a single wall system, wherein the coupled assembly flanges and enclosing support channel form a rigid wall stud member.

6 Claims, 1 Drawing Sheet

MODULAR WALL SYSTEM FOR CLEAN ROOM STRUCTURE

BACKGROUND OF THE INVENTION

1. Field of Invention

This invention pertains to a modular wall system adapted for use as part of a clean room structure. More particularly, the present invention relates to a modular construction wherein wall panels can be quickly assembled or disassembled, yet wherein the assembled wall structure is capable of being sealed at the juncture of each attached wall panel to develop a Class 10 clean room status.

2. Prior Art

Clean room structures are especially constructed enclosures which provide an environment free of dust and typical contaminating particles which are normally present in air. Such environments are required for the manufacture of sensitive electronic components, particularly integrated computer chips having hundreds of tiny circuits whose effective operation depends upon the absence of foreign materials. Such structures are classified, based upon the number of particles present in a cubic foot of air space. For example, a Class 10 clean room means that there are only ten or less particles of 0.5 microns in size or larger in a cubic foot of air space.

The construction of such specialized structures has traditionally required permanent construction techniques which offered little flexibility in terms of structural modifications in disassembly. Such permanent construction was believed necessary in order to develop the airtight enclosure required to meet clean room standards.

U.S. Pat. No. 4,667,579 discloses a modular construction which meets the stringent, airtight standards for a clean room but provides flexibility in disassembly and modification to variable structural configurations. A principle characteristic of the disclosed clean room includes the components and techniques for attaching a vertical strut or stud at the juncture of two panel elements in a manner such that complete sealing against particle infiltration was accomplished. These techniques included the use of a conventional steel stud which was slotted to receive a clip, wherein the mated clip was attachable to lateral flanges of two abutting panel sections. Such a configuration is shown in FIGS. 4 and 5 of the referenced patent.

Although such structure represented a significant improvement over prior art methods and apparatus for construction of modular clean room assemblies, tolerances of each component allowed a degree of misalignement which necessitated careful attention during assembly. Although careful construction techniques have traditionally been required in fabricating clean room structures, it would be a substantial improvement in the art if clean room structural components were self-adjusting to establish coalignment of panel sections within the single plane and complete sealing of panel junctures.

The concept of utilizing lateral flanges on separate panel sections is not unique to clean room construction. For example, U.S. Pat. No. 4,649,684 by Petree shows a panel section which includes lateral flanges capable of being clipped together by a channeled chip which enclosed a resulting "T" configuration formed by the abutting lateral flanges. Other techniques for structurally interlocking panel sections are represented in U.S. Pat. No. 4,461,131 by Pressell, U.S. Pat. No. 2,867,857 by McCarthy and U.S. Pat. No. 3,975,880 by Fischer, Jr. None of these patents, however, provides structure suitable for clean room construction wherein they are adapted to seal at the panel juncture and develop the level of parallel alignment which is needed to ensure full structural integrity in accordance with clean room specifications.

OBJECTS AND SUMMARY OF THE INVENTION

It is therefore an object of the present invention to provide a modular wall system which is capable of quick assembly wherein wall panel sections are automatically aligned along panel faces and at the abutting lateral flanges.

A further object of the present invention is to provide such a modular wall assembly wherein the panel junctures are easily sealed to meet clean room specifications.

A still further object of this invention is to provide a modular wall system in which lateral flanges of panel sections can be interlocked to form a wall stud providing reinforcement to the assembled wall structure.

Yet another object of this invention is to provide a modular wall system which meets clean room specifications, can be quickly assembled to include integrated wall stud structure, wherein the wall stud structure includes longitudinal channeling for running conduit for wiring and similar construction materials.

These and other objects are realized in a modular wall system which is adapted for use as part of a clean room structure wherein the wall system includes a unibody panel section of uniform width which is adapted for interlocking relationship with other panel sections to form an enclosing wall structure. Each panel section includes an exterior face, an interior face and laterally opposing assembly flanges which extend along the length of each edge of the panel sections. These assembly flanges are configured to be interlocked when panel sections are brought in common, side-by-side orientation wherein the interlocked flanges form a stud member for the wall system. The assembly flanges include (i) a flange side wall extending inward from the interior face of the panel to a distal edge of the side wall, (ii) an interlocking member coupled to the side wall and including means for secure fastening with respect to another interlocking member of an assembly flange for an adjoining panel section, and (iii) a sealing member including means for sealing openings between coupled assembly flanges. The interlocking flanges are enclosed by a support channel which is configured in size and shape for a snug fit around the coupled assembly flanges. Side walls of the support channel are structurally configured to operate as spacer members of equal length for aligning the panel sections in a common plane when a gripping means is applied between the support channel and the respective interlocking assembly flanges. The gripping means is structured such that its engagement and tightening with respect to the channel and enclosed flanges three conditions are developed. First, the respective side channel walls of the support channel are brought into abutting contact against the interior face of each respective panel section. Second, the coupled assembly flanges are rigidly secured with the channel to form a single stud member which provides vertical and transverse strength to coupled panel sections. Finally, the sealing members of each assembly flange are cooperatively engaged to provide a sealed juncture between each interlocking panel section.

Other objects and advantages of the present invention will be apparent to those skilled in the art, based upon the following detailed description, taken in combination with the accompanying drawings.

DETAILED DESCRIPTION OF THE INVENTION

Figure 1:
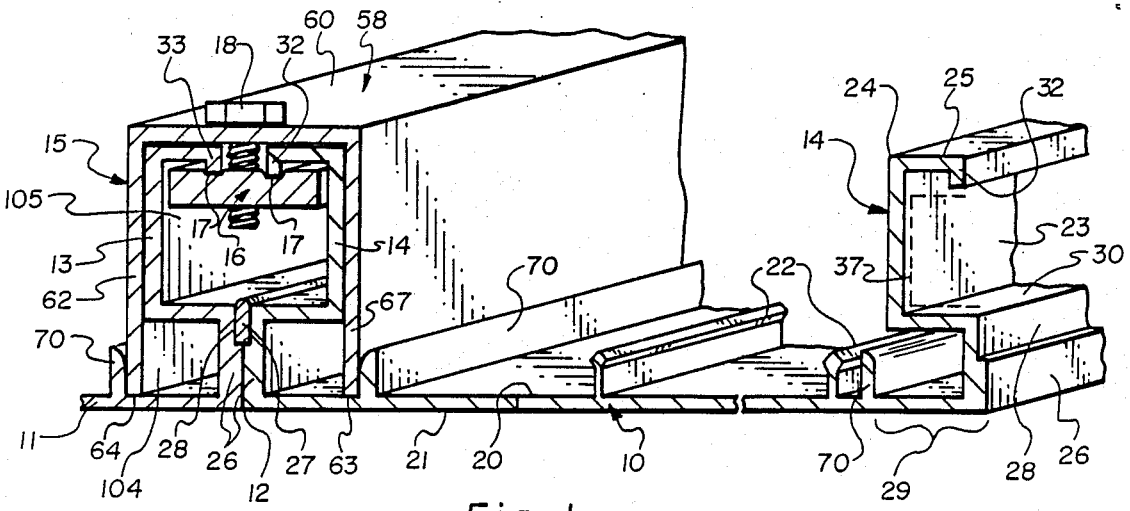
FIG. 1 shows a perspective partial view of two panel sections joined at their abutting assembly flanges with an enclosing support channel rigidly fixed in position.

Referring now to the drawings:

FIG. 1 discloses lateral end sections of two coupled panel sections 10 and 11. These panel sections 10 and 11 abut at juncture 12 at the point of attachment of laterally opposing assembly flanges 13 and 14. The abutting assembly flanges are enclosed within a support channel 15 which is interlocked with the assembly flanges by means of a nut 16 having slotted spacer channels 17 and an engaging bolt 18. These interlocking components including the assembly flanges 13 and 14, the support channel 15 and gripping means 16 and 18 are mutually assembled and engaged to develop a stud member which provides strength both vertically and in traverse orientation for an assembled modular wall system.

More specifically, each panel section 10 and 11 is constructed with a uniform width of a basic unitary dimension. For example, the panel section shown in FIG. 4 may be a one-foot, two-foot or one-yard section or comparable metric measurements which can be utilized to develop a total wall section of appropriate dimension by interlocking various unitary panel sections to realize the total width desired. The length of each panel section may vary and will be determined based on the height of the wall system required as well as locations of equipment ports at various positions along the wall system.

Each panel section 10 and 11 includes an interior face 20 and an exterior face 21. Typically, the exterior face 21 will form a planer surface which provides interior wall structure to the clean room assembly. The interior surface 20 may include structural reinforcing ribs 22 which typically run the total height of the panel section.

The assembly flanges 13 and 14 are constructed in uniform configuration to enable their common attachment with assembly flanges of other panels. Each assembled flange includes a flange side wall 23 which extends inward from the interior face 20 of the panel section to a distal edge 24, which is attached to an interlocking member 25 which provides means for a secure fastening of the assembly flange 14 with respect to another interlocking member of a comparable assembly flange on a second panel section.

The assembly flange 14 also includes a sealing member 26 having means 27 for sealing openings 28 between the coupled assembly flanges 13 and 14. Typically, this sealing means 27 comprises a flowable liquid such as a gel caulking capable of totally filling the sealing opening 28 as a full barrier against particle transmission through any gaps existing at the juncture 12 of the respective panels 10 and 11.

It will be apparent to those skilled in the art that each of these three components 23, 25 and 26 of the assembly flange may be formed in various configurations. For comparison purposes, the flange configuration shown in FIG. 1 is referred to as an inverted "5" shape wherein the vertical stem of the "5" represents the flange sealing member 26 with the attached horizontal member of the "5" shape comprising lateral segment 29 of the panel section and the vertical section of the squared "c" element of the "5" comprising the side wall 23 with joined horizontal elements 25 and 30. This "c" shape is more clearly represented by the broken line "c" 31. It will be noted that in this configuration, the top "c" shape forms part of the interlocking member, with the top terminal end 32 being operable to interlock with a corresponding terminal end 33 of adjoining flange 13. It should be noted that the sealing member 26 includes a notched section 28 which provides the sealing opening for receiving sealing means 27 within a resulting channel formed by the junction of corresponding notches 28 on each respective flange.

Figure 2:
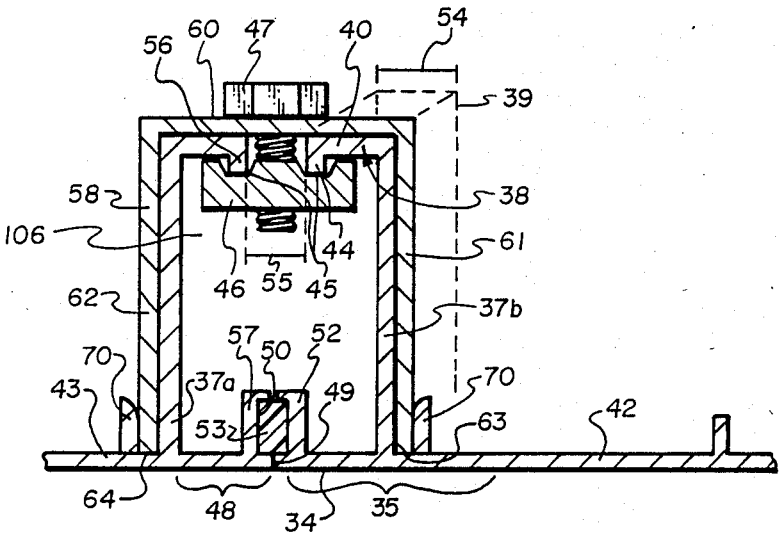
FIG. 2 shows an end view of an alternative embodiment of interlocking assembly flanges enclosed by the support channel.

FIG. 2 shows an alternate embodiment of the assembly flange which is configured as a squared "J". In this embodiment, the sealing member 34 includes one-half of the top, flat part of the inverted "J" 35 which couples centrally to the vertical stem 37, which element corresponds to the side wall 14 of FIG. 1. This side wall 37 or vertical stem of the "J" extends upward to the hook element of the "J", identified as item 38. This inverted "J" configuration is illustrated in hyphen line 39 for comparison purposes. The hook element 38 forms part of the interlocking member which functions similarly to element 25 and 32 of the assembly flange configuration in FIG. 1. More specifically, the hook element of the "J" comprises a flat section 40 which is substantially parallel with the panel section 42 and 43 and is attached at a top end of the stem 37. The hooked end of the "J" further includes a vertical leg 44, which corresponds to element 32 of FIG. 1. This vertical leg 44 seats within a groove 45 of the gripping means nut 46 engaged by the gripping means bolt 47. The sealing member of the "J" configuration comprises one-half 48 of the top, flat part 35 of the "J". This half segment 48 extends from the stem 37 to a proximate, distal side 49 of the panel section. The sealing opening 50 is formed by opposing channel walls 51 and 52. A sealing fluid 53 is loaded within the opening 50 to provide the desired barrier against particle intrusion.

It should be noted that the width of the sealing member 48 is greater than the width 54 of the hooked element of the "J". This results in a gap 55 between vertical legs 44 and 56. This gap provides an opening through which the gripping mold 47 may extend from the support channel 58.

Referring again to FIGS. 1 and 2, the support channel 58 is configured in size and shape for a snug fit around the coupled assembly flanges 13/14 and **37*a*/37*b*. This channel includes a channel cap 60 and side channel walls 61 and 62 which extend for equal lengths sufficient to abut against the interior faces 63 and 64 of the coupled panel sections. In this configuration, the channel walls 61 and 62 operate as spacer members of equal length for aligning the panel sections 10 and 11, 42 and 43. This spacer function is automatically imposed as the gripping means 16 and 18, 47 and 47 are engaged. Specifically, the assembly flange structure and the support channel are configured in size such that the gripping means pulls the assembly flanges toward the support channel cap 60, thereby driving the support channel side walls 61 and 62 toward the interior faces 63 and 64 of the panel sections. Because these side walls 61 and 62** are of equal length, the panel sections are brought into common, planer orientation when the gripping means is fully secured.

The flange assembly structure is properly sized to snugly fit within the support channel structure as is shown in the figures. The spacer or seating channels 17 (FIG. 1) and 45 (FIG. 2) receive the terminal ends 32 and 56 of the vertical legs for the respective assembly flanges. These seating channels are exactly spaced apart and chamfered at side walls to properly align the interlocking members 25 or 38 in the attached assembly flange structure. It will be apparent to those skilled in the art that other forms of gripping means can be envisioned besides the nut and bolt combination as shown in the figures. For example, a latch assembly could be alternated for the nut and bolt combination, wherein the latch extends upward through the support channel and permits lever action to engage an aligning element such as shown in FIGS. 1 and 2 as items 16 and 46.

In view of the foregoing description, it will now become apparent that three conditions are satisfied as the gripping means are engaged and secured to their locked position. Specifically, as the gripping means pulls the support channel 58 in the coupled assembly flanges 13/14 and **37*a*/37*b* into nesting configuration, (i) the respective channel side walls 61 and 62 of the support channel are firmly abutting against the interior faces 63 and 64 of the panel sections. Also, the coupled assembly flanges are rigidly secured with the channel 58 to form a single stud member which provides vertical and transverse strength to the coupled panel sections. Finally, the sealing members 26 and 52/57 are cooperatively engaged to provide a sealed juncture 27 and 53** between the respective panel sections.

This fully secured condition may be enhanced by use of projecting guide flanges 70 which are aligned in substantial parallel orientation with the assembly flanges and are displaced slightly inward along the interior face of the panel to properly position the side channels 61 and 62 in tight fit between the single flange and the guide flanges 70.

Figure 3:
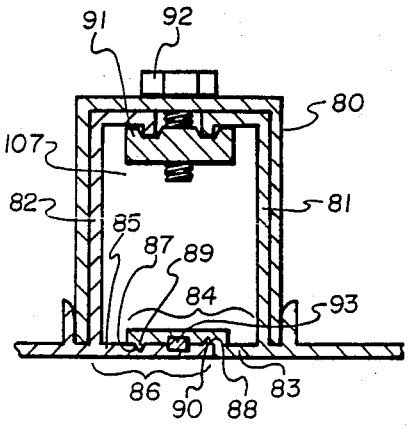
FIG. 3 discloses a third embodiment wherein the sealing member is adapted with spacing guide to further ensure correct alignment of the coupled panel sections.

FIG. 3 discloses an additional spacer guide assembly which is configured as part of the sealing member. Specifically, a "U" shaped support channel 80 is shown engaged around a pair of "J" shaped assembly flanges 81 and 82. The sealing member of assembly flange 81 is identified as item 83 which extends over width 84. Similarly, sealing member 85 of flange 82 extends over width 86. Each respective sealing member includes a notch 87 and 88 and engaging tooth 89 and 90. As the nut 91 and bolt 92 are secured in a seated position, the respective teeth of the sealing members 83 and 85 seat in corresponding notches, further securing the proper alignment of the assembly flanges. A sealing opening 93 retains a sealing gel in accordance with previous description. This configuration further operates to retain the sealing member in firm, sealing contact.

Figure 4:
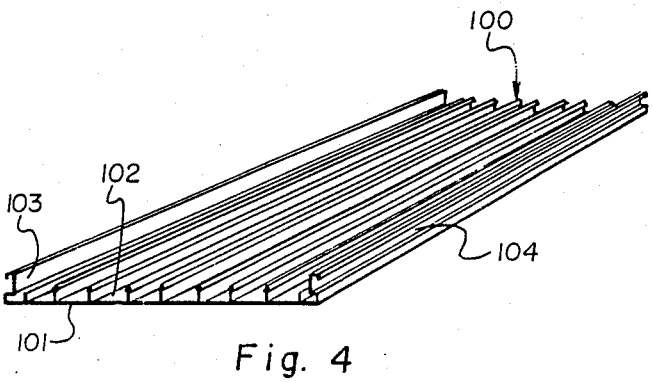
FIG. 4 is a perspective view of a panel section embodying the features of the present invention.

FIG. 4 illustrates a sample wall section 100 which includes an exterior face 101 and interior 102. Opposing assembly flanges 103 and 104 provide means for interlocking each panel section to an adjacent panel section in common, planer configuration. The description of such assembly flanges has been adequately presented in previous discussion. A plurality of such panels 100 are secured together in side-by-side array to form a wall structure, which is capable of operating within the clean room specifications previously described. In addition to providing wall structure, the assembly flanges include conduit channels 104, 105, 106 and 107 which facilitate protective enclosure of electrical conduit, telephone line, etc.

In view of the foregoing description, it will be apparent to those skilled in the art that numerous advantages arise because of the component structure. Specifically, the complex construction of clean room wall structure has now been reduced to three simple components. First is a single panel section 100 which already includes the opposing assembly flanges 103 and 104. Such panel structure and support channel may be fabricated by extrusion, using composition such as polymers, aluminium, composites or other suitable materials. Such panel sections 100 are quickly assembled by bringing two panel sections in approximately co-planer alignment with the assembly flanges in abutting configuration. A sealing composition such as silicone or some other form of caulking gel is loaded within the sealing opening 28 and the support channel 58 with gripping means 17/18 is positioned around the abutting assembly flanges. By tightening the gripping means 18, panel walls are automatically aligned in co-planer relationship with the junction 12 of the two panels being fully sealed by the loaded sealing composition 27. Accordingly, the complex prior art process of constructing a clean room wall system is now reduced to several simple steps which automatically result in proper alignment and sealing of wall junctures.

It will be apparent to those skilled in the art that the present disclosure is merely by way of example, and is not to be construed as limiting upon the following claims.

We claim:

1. A modular wall system adapted for use as part of a clean room structure wherein the wall system is capable of developing a Class 10 clean room status, said system comprising:

(a) a unibody panel section of uniform width and variable length, said section including (i) an exterior face, (ii) an interior face, and (iii) laterally opposing assembly flanges extending along the length of each edge of the panel section which can be interlocked with a comparable assembly flange of a second unibody panel section brought in common, side-by-side orientation with the first panel section, the interlocked flanges cooperating to form part of a single reinforcing stud member for the wall system;

(b) said assembly flanges each including (i) a flange side wall extending inward from the interior face of the panel section (ii) an interlocking member coupled to the flange side wall and including means for secure fastening with respect to another interlocking member of an assembly flange for the second panel section, and (iii) a sealing member including means for sealing openings between coupled assembly flanges, said assembly flanges each being configured in an inverted "J" shape with the lower, hooked element of the "J" forming the interlocking member and the top of the "J" forming part of the sealing member, the hooked element and top being joined by a vertical stem to complete the "J" configuration;

(c) a support channel configured in size and shape for a snug fit around the coupled assembly flanges, said channel including (i) a channel cap and (ii) side channel walls which extend for equal lengths sufficient to abut against the interior faces of the coupled panel sections, said side channel wall being operable as spacer members of equal length for aligning the panel sections in a common plane; and (d) gripping means coupled between the support channel and the respective interlocking members of the coupled assembly flanges for gripping the coupled assembly flanges in a configuration in which (i) the respective side channel walls of the support channel are firmly abutting against the interior faces of coupled panel sections, (ii) the coupled assembly flanges are rigidly secured with the channel to form a single stud member which provides vertical and transverse strength to the coupled panel sections, and (iii) the sealing members of each assembly flange are cooperatively engaged to provide a sealed juncture between the respective panel sections.

2. A modular wall as defined in claim 1, wherein the gripping means comprises a nut and bolt, said bolt being mounted at an exterior face of the channel support and extending therethrough and between the interlocking member, said nut including spacer means for correctly spacing the vertical legs as the gripping means is engaged, as well as developing the required structural relationships (i) to (iii) defined for the gripping means.

3. A modular wall as defined in claim 2, wherein the spacer means comprises a pair of seating channels configured to receive terminal ends of the vertical legs of two coupled assembly flanges, said seating channels being correctly spaced apart to thereby properly align the end pieces of the vertical legs and attached assembly flanges as they seat within the seating channels.

4. A modular wall system adapted for use as part of a clean room structure wherein the wall system is capable of developing a Class 10 clean room status, said system comprising:

(a) a unibody panel section of uniform width and variable length, said section including (i) an exterior face, (ii) an interior face, and (iii) laterally opposing assembly flanges extending along the length of each edge of the panel section which can be interlocked with a comparable assembly flange of a second unibody panel section brought in common, side-by-side orientation with the first panel section, the interlocked flanges cooperating to form part of a single reinforcing stud member for the wall system;

(b) said assembly flanges each including (i) a flange side wall extending inward from the interior face of the panel section (ii) an interlocking member coupled to the flange side wall and including means for secure fastening with respect to another interlocking member of an assembly flange for the second panel section, and (iii) a sealing member including means for sealing openings between coupled assembly flanges, each of said flange assemblies being configured in the shape of an inverted "5" with the lower, vertical stem of the "5" forming part of the sealing member and the top "c" configuration of the "5" forming part of the interlocking member, the top terminal end of the "c" being operable to interlock with the corresponding terminal end of a "c" of an adjoining assembly flange;

(c) a support channel configured in size and shape for a snug fit around the coupled assembly flanges, said channel including (i) a channel cap and (ii) side channel walls which extend for equal lengths sufficient to abut against the interior faces of the coupled panel sections, said side channel wall being operable as spacer members of equal length for aligning the panel sections in a common plane; and (d) gripping means coupled between the support channel and the respective interlocking members of the coupled assembly flanges for gripping the coupled assembly flanges in a configuration in which (i) the respective side channel walls of the support channel are firmly abutting against the interior faces of coupled panel sections, (ii) the coupled assembly flanges are rigidly secured with the channel to form a single stud member which provides vertical and transverse strength to the coupled panel sections, and (iii) the sealing members of each assembly flange are cooperatively engaged to provide a sealed juncture between the respective panel sections.

5. A modular wall system as defined in claim 4, wherein the sealing member includes a sealing channel formed by abutment of corresponding notches formed in respective stems of the flange assembly, said channel being operable to receive a sealing fluid therein.

6. A modular wall system adapted to use as part of a clean room structure wherein the wall system is capable of developing a Class 10 clean room status, said system comprising:

(a) a unibody panel section of uniform width and variable length, said section including (i) an exterior face, (ii) an interior face, and (iii) laterally opposing assembly flanges extending along the length of each edge of the panel section which can be interlocked with a comparable assembly flange of a second unibody panel section brought in common, side-by-side orientation with the first panel section, the interlocked flanges cooperating to form part of a single reinforcing stud member for the wall system;

(b) said assembly flanges each including (i) a flange side wall extending inward from the interior face of the panel section (ii) an interlocking member coupled to the flange side wall and including means for secure fastening with respect to another interlocking member of an assembly flange for the second panel section, and (iii) a sealing member including means for sealing openings between coupled assembly flanges;

(c) a support channel configured in size and shape for a snug fit around the coupled assembly flanges, said channel including (i) a channel cap and (ii) side channel walls which extend for equal lengths sufficient to abut against the interior faces of the coupled panel sections, said side channel wall being operable as spacer members of equal length for aligning the panel sections in a common plane;

(d) gripping means coupled between the support channel and the respective interlocking members of the coupled assembly flanges for gripping the coupled assembly flanges in a configuration in which (i) the respective side channel walls of the support channel are firmly abutting against the interior faces of coupled panel sections, (ii) the coupled assembly flanges are rigidly secured with the channel to form a single stud member which provides vertical and transverse strength to the coupled panel sections, and (iii) the sealing members of each assembly flange are cooperatively engaged to provide a sealed juncture between the respective panel sections, and (e) a guide flange projecting in parallel orientation with the assembly flange and displaced slightly inward along the interior face of the of the panel section to properly position the side channel walls in tight fit between the assembly flange and the guide flange.

* * * * *